United States Patent [19]

Forni

[11] Patent Number: 4,653,302

[45] Date of Patent: Mar. 31, 1987

[54] ROLLING STAND WITH DEVICE FOR ANGULARLY ADJUSTING THE ROLL POSITION

[75] Inventor: Luigi Forni, Castellanza, Italy

[73] Assignee: Pomini Farrel S.p.A., Milan, Italy

[21] Appl. No.: 675,442

[22] Filed: Nov. 27, 1984

[30] Foreign Application Priority Data

Dec. 23, 1983 [IT] Italy ..... 24369 A/83

[51] Int. Cl.[4] ..... B21B 31/16; B21H 8/00

[52] U.S. Cl. ..... 72/195; 74/401; 403/59; 403/118

[58] Field of Search ..... 72/195; 74/401, 409; 464/1, 160; 403/59, 60, 118, 342

[56] References Cited

U.S. PATENT DOCUMENTS

| | | | |
|---|---|---|---|
| 1,391,777 | 9/1921 | Jacobson | 464/160 |
| 1,868,385 | 7/1932 | Greenwood | 74/401 |
| 2,087,831 | 7/1937 | Anderson | 72/195 |
| 2,810,275 | 10/1957 | Peterson, Jr. | 464/160 |
| 3,549,071 | 12/1970 | Beery | 464/160 |
| 3,563,076 | 2/1971 | Daniel | 72/195 |
| 4,196,046 | 4/1980 | McConnel | 72/195 |

FOREIGN PATENT DOCUMENTS

| | | | |
|---|---|---|---|
| 1201535 | 8/1970 | United Kingdom | 72/195 |
| 721134 | 3/1980 | U.S.S.R. | 72/195 |

*Primary Examiner*—Lowell A. Larson

*Attorney, Agent, or Firm*—Morgan & Finnegan

[57] ABSTRACT

The invention relates to a rolling stand, in particular with rolls comprising grooves provided with essentially radial repetitive notches for the production of ribbed, threaded and similar bars, stand being provided with a device for angularly adjusting the roll position, which is operable in an immediate and simple manner.

2 Claims, 6 Drawing Figures

Fig.1
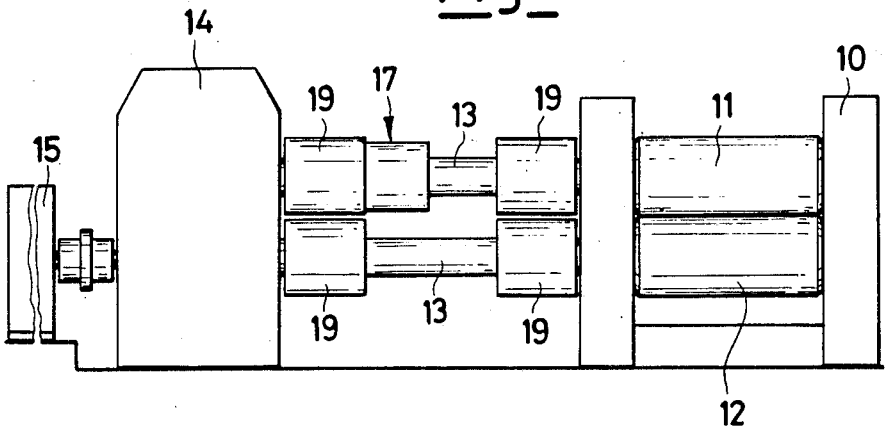
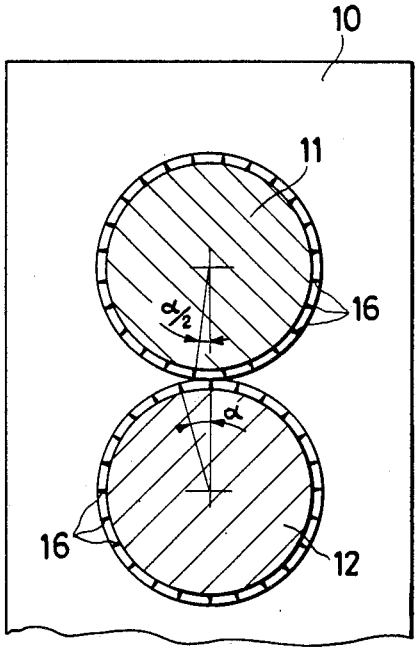
Fig.2

ROLLING STAND WITH DEVICE FOR ANGULARLY ADJUSTING THE ROLL POSITION

TECHNICAL FIELD

This invention relates to a device for angularly adjusting the rolls forming part of finishing stands of a rolling mill equipped for the production of ribbed or threaded bars, or bars comprising special projections at constant pitch and/or at predetermined distances along the bar.

BACKGROUND AND OBJECTS OF THE INVENTION

The finishing stands of a rolling mill for producing bars comprising special essentially transverse ribs or profiles or for producing threaded bars are provided with rolls, the surface of which comprises notches or profiles repeated at constant pitch along the entire roll circumference.

This dictates the need for fairly precise adjustment during the assembly of the stand and the making of the motor, spindle and stand connections.

In this respect, the pair of rolls must be set angularly relative to each other in a special manner so as to exactly position the grooves provided in the two rolls in the manner required by the type of rolling operation.

Such an adjustment is lengthy and difficult in known rolling mills and is usually carried out with the spindles detached from the rolls, and in addition does not allow rapid correction if the rolls are found to be out of phase during assembly due to errors or play in the transmission linkage.

One object of the present invention is to provide an angular adjustment device for the rolls which enables rapid action to be taken in correcting phasing errors between the stand rolls.

A further object is to make said adjustment without dismantling stand components or disconnecting couplings or spindles.

SUMMARY OF THE INVENTION

These and further objects are attained according to the present invention by a rolling stand, in particular with a pair of finishing rolls having essentially radial projections or notches inside the grooves of the sized passes, characterised by comprising a device for angularly adjusting an upper roll and a lower roll with respect to each other without disconnecting and removing the motion transmission means.

BRIEF DESCRIPTION OF THE DRAWINGS

The characteristics and advantages of the device according to the invention will be more apparent from the description given hereinafter of non-limiting embodiments thereof, illustrated on the accompanying diagrammatic drawings in which:

FIG. 1 is an elevational view of a rolling stand with an angular adjustment device of the invention on the upper spindle;

FIG. 2 is a cross-section through the rolls;

DETAILED DESCRIPTION OF THE PREFERRED EMBODIMENTS

Figure 3:
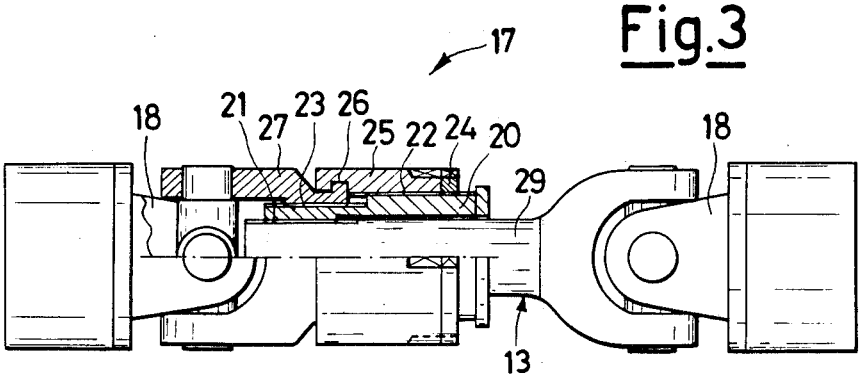
FIG. 3 is a partly sectional view of a spindle provided with a device according to the present invention.

With particular reference to FIG. 1, in a rolling mill a roll housing 10 essentially comprises an upper roll 11 and a lower roll 12 which are connected by two spindles 13 to a pinion housing 14, which obtains its motion from a drive unit 15.

The rolls 11 and 12 each comprise mutually facing grooves defining sized passes (not shown) and provided along their circumference with a series of essentially radial notches 16 shown diagrammatically in the sectional view of FIG. 2 and disposed at a distance apart such as to form an angle $\alpha$ at the centre. It is apparent that the maximum angle by which a notch 16 on the roll 11 and the corresponding notch 16 on the roll 12 can be out of phase is $\alpha/2$.

Figure 4:
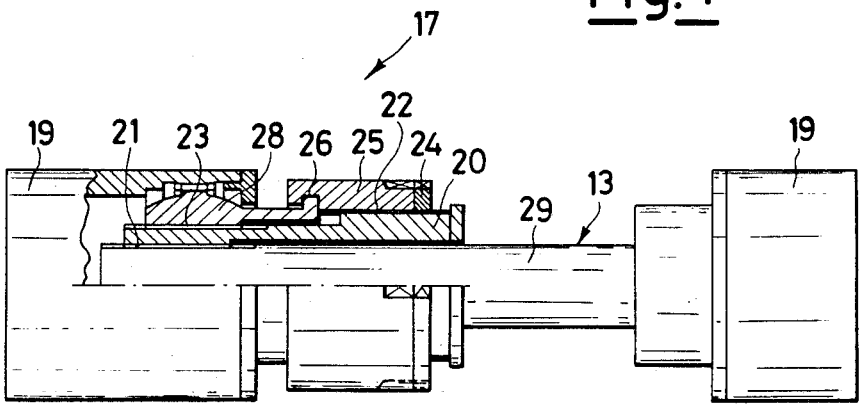
FIG. 4 is a view equivalent to that of FIG. 3 but with a different type of coupling.

As shown in FIGS. 1, 3 and 4, the upper spindle 13 is provided with an adjustment device constructed in accordance with the present invention and indicated overall by 17. The spindle 13 shown in FIG. 3 is provided at its ends with universal couplings 18, whereas the spindle 13 of FIG. 4 comprises toothed couplings 19, but these do not modify the operation of the device 17.

Each of the two devices 17 comprises a sleeve 20 provided internally with a splined portion 21 and externally with a thread 22 at one end, this end being enlarged, and with helical toothing 23 at the other end.

On to the threaded portion 22 there are screwed into position a locking ring 24 and a ring nut 25 which is secured in a freely rotatable manner at 26 to a portion 27 of a universal coupling 18 or to an inner portion 28 of a toothed coupling 19, both said portions 27 and 28 comprising internally a bore which is toothed in a complementary manner to the helical toothing 23.

An end portion of the shaft 29 of the spindle 13 is splined in a complementary manner to the inner part of the sleeve 20. When the required phasing between the notches 16 of the upper roll 11 and the notches 16 of the lower roll 12 is to be effected, the procedure is as follows. The locking ring 24 is slackened to release it from the ring nut 25, this latter thus being free to rotate.

On rotating the ring nut 25, which is locked in a freely rotatable manner at 26 to a portion 27 and/or 28 of the couplings 18 or 19, the sleeve 20 is made to advance axially by virtue of the complementary threads 22.

The fact that the inner helical toothing 23 on the end portion 27 or 28 of the couplings 18 or 19 engages with a complementary toothed portion 23 on the sleeve 20 also results in a rotation of the spindle 13 or more precisely of the shaft 29 coupled to the sleeve 20 by means of the splined portion 21.

Figure 5:
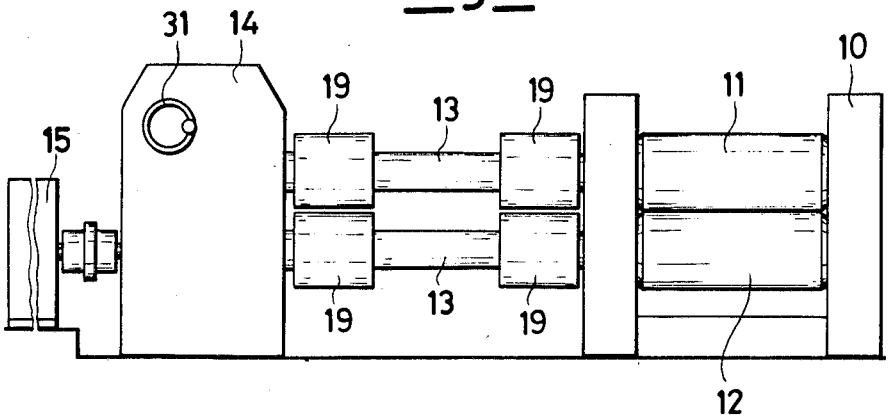
FIG. 5 is an elevational view of a rolling stand with the adjustment device inside the pinion housing.
Figure 6:
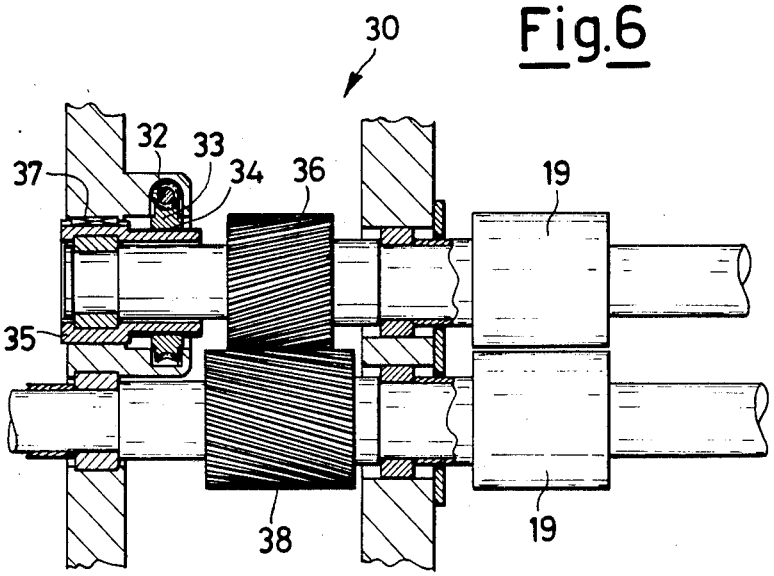
FIG. 6 is a sectional detail of the pinion housing of FIG. 5.

The spindle 13 and the coupling 18 or 19 connected to the roll 11 thus undergo a rotary displacement, allowing the notches 16 of the two rolls 11 and 12 to be angularly adjusted to the required phasing. When the adjustment has been made, the locking ring 24 is tightened against the ring nut 25, giving consequent angular locking of the mutual positions of the two rolls 11 and 12. A further example of an adjustment device according to the present invention is shown in FIGS. 5 and 6. In particular, said adjustment device, indicated overall by 30, has been inserted into a pinion housing 14 and is operated from the outside thereof by means of a control handwheel 31.

Said handwheel 31 operates a worm 32 rigid therewith and engaging a complementary toothed wheel 33. The toothed wheel 33, of annular cross-section, comprises internally a thread 34 which engages a complementary threaded portion of a sleeve 35 containing the bearing of the upper pinion 36 mounted to the shaft portion of upper pinion 36.

A key 37 is positioned between the load-bearing structure and sleeve 35 to prevent rotation of said sleeve 35, while at the same time allowing it to move freely in an axial direction.

In this respect, on operating the handwheel 31, the worm 32 is rotated with consequent rotation of the toothed wheel 33. Said movement also causes rotation of the thread 34 and mutual sliding of the complementary thread 34 provided on the sleeve 35, thus causing this latter to move axially with consequent axial movement of the upper pinion 36.

As the lower pinion 38 meshes with said pinion 36, the mutual sliding produces a rotary displacement of their helical profiles, with consequent angular adjustment of the lower roll 12.

The presence of the toothed couplings 19 on the spindle 13 does not hinder this. Rather, the reciprocal axial movement provided by toothed coupling 19 between upper pinion 36, specifically the shaft of upper pinion 36, and spindle 13 permits axial movement of pinion 36 without causing corresponding axial movement of upper spindle 13 and roll 11.

Thus again in this example, angular adjustment between the pairs of rolls 11 and 12 is effected simply and without the need for any dismantling.

Such an adjustment could also be made with the machine in motion.

The examples described heretofore and shown diagrammatically on the drawings are to be considered as illustrative of the present invention but not limitative thereof.

In this respect, numerous modifications can be made as dictated by contingent requirements, but without leaving the scope of the inventive idea.

I claim:

1. A rolling stand comprising:

a roll housing;

a pair of finishing rolls including an upper roll and a lower roll, said rolls having essentially radial projections or notches inside grooves of sized passes therebetween, said rolls being mounted on spindles rotatably connected to and supported by said roll housing by roll housing connecting means, said spindles also being rotatably connected to and supported by a pinion housing by pinion housing connecting means;

drive means attached to at least one of said spindles for providing rotational motion to said spindles and to said finishing rolls mounted thereon;

angular adjustment means for angularly adjusting said upper and said lower rolls with respect to one another without disconnecting said drive means, said angular adjustment means being disposed between said drive means and said roll housing, said angular adjustment means further including, (a) an axially sliding sleeve axially slidably mounted over at least one one of said spindles and being rotatably connected therewith so as to permit only axial movement of said sleeve relative to said spindle, said sleeve having an outer helical toothing covering one portion thereof and an outer normal thread covering another portion thereof, and (b) conversion means for converting axial sliding movement of said sleeve relative to said one spindle into angular rotation of at least one of said rolls relative to the other of said rolls, said conversion means including, (i) a sleeve coupling secured relative to said pinion housing connecting means and having an inner helical toothing corresponding to and engaging said outer helical toothing on said sleeve, (ii) a ring nut freely rotatable around said sleeve and having ring nut threads corresponding to and engaging said outer normal thread on said sleeve, said ring nut being rotatably secured to said sleeve coupling and longitudinally fixed thereto so as to prevent movement of said ring nut relative to said sleeve coupling in the direction of the axis of said sleeve, so that as said ring nut is rotated relative to said sleeve the threaded engagement of said sleeve and said ring nut forces said sleeve to slide axially along said one spindle, whereupon said inner helical toothing on said sleeve coupling imparts angular rotational movement to said sleeve and to said one spindle, thereby causing angular adjustment of said rolls with respect to one another, and (iii) ring nut locking means mounted on said sleeve and disposed between said sleeve and said ring nut for selectively securing said ring nut relative to said sleeve, thereby selectively preventing rotational movement of said ring nut relative to said sleeve.

2. A rolling stand comprising:

a pair of finishing rolls mounted on spindles, said rolls including upper and a lower rolls having essentially radial projections or notches inside grooves of sized passes therebetween;

a roll housing supporting said finishing rolls;

drive means connected to at least one of said spindles for providing rotational motion to said spindles and said finishing rolls;

a pinion housing disposed between said drive means and said roll housing such that said upper and lower rolls mounted on spindles communicate by toothed couplings with the shaft portion of upper and lower pinions, said upper and lower pinions having mutually engaging helical profiles;

angular adjustment means for angularly adjusting said upper and said lower rolls with respect to one another without disconnecting said drive means, said angular adjustment means including an axially sliding sleeve mounted on the shaft portion of at least one of said pinions such that said sleeve internally supports the bearings of said one pinion, said sleeve being provided with an external threaded portion and being movable relative to said one pinion only along the axis of said one pinion, said angular adjustment means further including conversion means for converting axial sliding movement of said sleeve relative to said one pinion into angular rotation of said one pinion relative to the other said pinion, thereby causing angular rotation of said spindles and said rolls relative to each other, said conversion means further including a worm mounted within said pinion housing and attached to a control hand wheel external to said pinion housing, said worm engaging a toothed wheel having a toothed wheel thread corresponding to and engaging said external threaded portion on said sleeve, such that rotation of said control handwheel rotates said worm and said toothed wheel to impart axial sliding motion to said sleeve, thereby causing axial movement of said one pinion relative to the other of said pinions so that said mutually engaging helical pinion profiles provide angular adjustment of said rolls relative to each other; and a key disposed between said sleeve and said pinion housing to prevent rotation of said sleeve relative to said pinion housing.

* * * * *